US012790916B1

(12) United States Patent
Dave et al.

(10) Patent No.: US 12,790,916 B1
(45) Date of Patent: Nov. 10, 2026

(54) DOWNHOLE TOOL HAVING HIGH AMPLIFIED AND LOW AMPLIFIED STROKE PORTIONS

(71) Applicant: Halliburton Energy Services, Inc., Houston, TX (US)

(72) Inventors: Jalpan Piyush Dave, Singapore (SG); Michael Fripp, Houston, TX (US); Paul James, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/366,242

(22) Filed: Oct. 22, 2025

(51) Int. Cl.
*E21B 34/10* (2006.01)

(52) U.S. Cl.
CPC ..... *E21B 34/10* (2013.01); *E21B 2200/06* (2020.05)

(58) Field of Classification Search
CPC ..... E21B 34/14; E21B 34/10; E21B 34/06; E21B 34/00; E21B 2200/06
See application file for complete search history.

(56) References Cited

U.S. PATENT DOCUMENTS 4,545,433 A 10/1985 Wambaugh
4,756,372 A * 7/1988 Airey ..... E21B 34/14 166/373
5,101,904 A 4/1992 Gilbert
5,101,907 A * 4/1992 Schultz ..... E21B 23/0412 166/336
5,429,036 A 7/1995 Latos
6,073,708 A 6/2000 Brown et al.
6,289,998 B1 9/2001 Krueger et al.
6,796,120 B2 9/2004 Franchet et al.
7,051,526 B2 5/2006 Geiger
7,117,949 B2 10/2006 Doane et al.
(Continued)

FOREIGN PATENT DOCUMENTS

BR 112021007440 A2 7/2021
EP 0661459 A1 7/1995
(Continued)

OTHER PUBLICATIONS

Enerpac. "Pascal's Law and Hydraulic Tools." Enerpac Company Website, https://blog.enerpac.com/pascals-law-and-hydraulic-tools/. Accessed May 14, 2025.
(Continued)

*Primary Examiner* — Daniel P Stephenson
(74) *Attorney, Agent, or Firm* — Scott Richardson; C. Tumey Law Group, PLLC

(57) ABSTRACT

Disclosed herein are numerous examples of downhole tools comprising a hydraulic actuator having a hydraulic actuator stroke with an high amplified portion and low amplified portion, a first piston head area moving with the hydraulic actuator stroke to create fluid forces, and a second piston head area in fluid communication with the first piston head area such that during the high amplified portion of the hydraulic actuator stroke the fluid forces at the first piston head area are transferred to the second piston head area and amplified while during the low amplified portion of the hydraulic actuator stroke the fluid forces at the first piston head area are transferred to the second piston head area but are low amplified.

20 Claims, 10 Drawing Sheets

(56) References Cited

U.S. PATENT DOCUMENTS

| | | | | |
|---|---|---|---|---|
| 7,134,499 | B2 | 11/2006 | Wilson et al. | |
| 7,614,454 | B2 * | 11/2009 | Buyers | E21B 34/08 166/386 |
| 8,281,767 | B2 * | 10/2012 | Kuhnke | F02M 59/08 123/511 |
| 9,121,250 | B2 * | 9/2015 | Godfrey | E21B 47/138 |
| 9,383,029 | B2 | 7/2016 | Scott | |
| 9,551,200 | B2 | 1/2017 | Read et al. | |
| 9,702,229 | B2 | 7/2017 | Zhou | |
| 10,066,466 | B2 | 9/2018 | Radtke | |
| 10,132,135 | B2 | 11/2018 | Gaude | |
| 10,563,676 | B1 * | 2/2020 | Theobald | F15B 15/02 |
| 10,883,332 | B2 | 1/2021 | Zhao et al. | |
| 11,261,697 | B2 | 3/2022 | Tusing et al. | |
| 12,473,795 | B2 * | 11/2025 | Dave | E21B 23/06 |
| 12,644,351 | B1 | 6/2026 | Thangarajoo et al. | |
| 2002/0070015 | A1 | 6/2002 | Armell et al. | |
| 2004/0028543 | A1 | 2/2004 | Rapp | |
| 2005/0091972 | A1 | 5/2005 | Redman | |
| 2008/0111431 | A1 | 5/2008 | Dorel | |
| 2009/0159290 | A1 | 6/2009 | Lauderdale | |
| 2011/0232474 | A1 * | 9/2011 | Geiger | E21B 33/06 91/159 |
| 2013/0000922 | A1 | 1/2013 | Skinner et al. | |
| 2013/0118758 | A1 * | 5/2013 | Caminari | E21B 23/006 166/373 |
| 2014/0048288 | A1 | 2/2014 | Clemens et al. | |
| 2015/0136393 | A1 * | 5/2015 | Turley | E21B 23/00 166/382 |
| 2016/0258252 | A1 | 9/2016 | Fripp et al. | |
| 2016/0273305 | A1 | 9/2016 | Murphree et al. | |
| 2016/0326804 | A1 | 11/2016 | Gao | |
| 2017/0248009 | A1 | 8/2017 | Fripp et al. | |
| 2017/0321515 | A1 * | 11/2017 | Stæhr | E21B 33/1277 |
| 2017/0343019 | A1 | 11/2017 | Thomson et al. | |
| 2018/0305999 | A1 | 10/2018 | Dave et al. | |
| 2019/0112895 | A1 | 4/2019 | Greci et al. | |
| 2019/0120258 | A1 * | 4/2019 | Zavadinka | F15B 11/0325 |
| 2019/0271332 | A1 * | 9/2019 | Todsen | F15B 15/1457 |
| 2021/0071501 | A1 | 3/2021 | Minassa et al. | |
| 2021/0102440 | A1 | 4/2021 | Minassa et al. | |
| 2023/0072189 | A1 | 3/2023 | Mothilal et al. | |
| 2023/0272685 | A1 | 8/2023 | Dave et al. | |
| 2024/0318519 | A1 | 9/2024 | Provost | |
| 2024/0426190 | A1 | 12/2024 | Eldho et al. | |
| 2025/0084736 | A1 | 3/2025 | Vasques | |
| 2025/0223882 | A1 | 7/2025 | Dave et al. | |

FOREIGN PATENT DOCUMENTS

| | | | | | |
|---|---|---|---|---|---|
| GB | 2552994 | A | | 2/2018 | |
| JP | H05187404 | A | | 7/1993 | |
| NO | 179880 | B | * | 9/1996 | E21B 21/08 |
| NO | 335376 | B1 | * | 12/2014 | E21B 34/10 |
| RU | 2184281 | C2 | * | 6/2002 | |
| VN | 10043692 | B | * | 2/2025 | |
| WO | 1999035365 | A2 | | 7/1999 | |
| WO | 2017203288 | A1 | | 11/2017 | |
| WO | WO-2019089487 | A1 | * | 5/2019 | E21B 34/066 |

OTHER PUBLICATIONS

Retsetman YouTube Video. "3D printed Gearbox powered Linear Actuator | High Torque." Uploaded Jan. 11, 2011. YouTube Website, https://www.youtube.com/watch?v=NLscbeoljAY. Accessed May 14, 2025.

ScienceWorld YouTube Video. "How a hydraulic jack works (3D Animation | Pascal Principle)." Uploaded Apr. 25, 2021. YouTube Website, https://www.youtube.com/watch?v=42dtoqUKY8l. Accessed May 14, 2025.

Saifullah, A.Z.A. et al. "Design, Construction and Performance Test of a Hydraulic Pressure Intensifier." The Experiment International Journal of Science and Technology, vol. 18, No. 3, Jan. 2014, pp. 1268-1283. PDF file. 17 pages.

Halliburton. "HS Interval Control Valves." Halliburton Data Sheet, 2024. H06970 Nov. 2024. PDF file. 3 pages.

U.S. Appl. No. 63/781,569, filed Apr. 1, 2025.

U.S. Appl. No. 19/040,555, filed Jan. 29, 2025.

International Search Report and Written Opinion for International Patent Application No. PCT/US2025/058157 dated Jul. 15, 2026. PDF file. 9 pages.

International Search Report and Written Opinion for International Patent Application No. PCT/US2025/058173 dated Jul. 16, 2026. PDF file. 7 pages.

International Search Report and Written Opinion for International Patent Application No. PCT/US2025/058176 dated Jul. 16, 2026. PDF file. 6 pages.

Non-Final Office Action for U.S. Appl. No. 19/366,212 dated Jul. 10, 2026. PDF file. 22 pages.

International Search Report and Written Opinion for International Patent Application No. PCT/US2025/058162 dated Jul. 9, 2026. PDF file. 7 pages.

* cited by examiner

DOWNHOLE TOOL HAVING HIGH AMPLIFIED AND LOW AMPLIFIED STROKE PORTIONS

BACKGROUND

In the resource recovery industry, there is often need to control tools using electric or electro-hydraulic actuators. These actuators need to generate significant power to actuate the downhole tools, yet they must fit into extremely tight spaces due to the physical constraints of the wellbore. Generally speaking, the smaller an actuator, the smaller the force/pressure it can generate. There is therefore a need to be able to use small and compact actuators and yet be able to actuate downhole tools in harsh environments.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
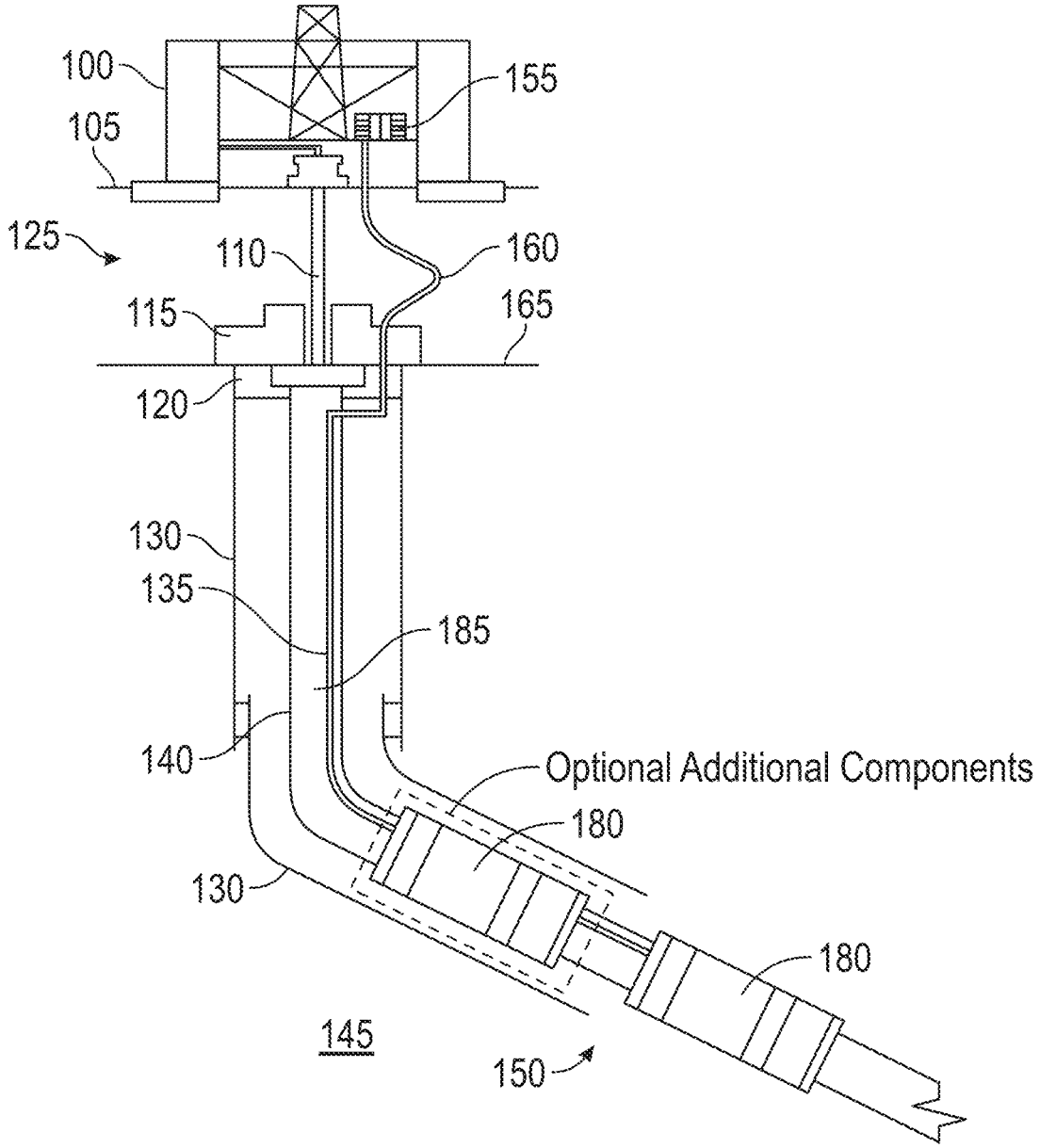
FIG. 1 illustrates a schematic view of a well system that may employ the principles of the present disclosure within one or more downhole tools.

Disclosed herein are numerous examples of downhole tools comprising a hydraulic actuator having a hydraulic actuator stroke with an high amplified portion and low amplified portion, a first piston head area moving with the hydraulic actuator stroke to create fluid forces, and a second piston head area in fluid communication with the first piston head area such that during the high amplified portion of the hydraulic actuator stroke the fluid forces at the first piston head area are transferred to the second piston head area and amplified while during the low amplified portion of the hydraulic actuator stroke the fluid forces at the first piston head area are transferred to the second piston head area but are low amplified.

Further downhole tools comprising a short stroke piston having a piston head area in fluid communication with the first piston head area where the short stroke piston is mechanically coupled to the sleeve. Further downhole tools comprising a valve block placed in fluid communication with the first piston head area. Further downhole tools comprising a narrow portion of a valve block housing which surrounds the valve block, and a wide portion of a valve block housing connected to the narrow portion of the valve block housing, wherein the valve block travels between both the narrow portion and the wide portion.

Further downhole tools wherein the low amplified portion of the hydraulic actuator stroke occurs when the valve block is within the wide portion of the valve block housing. Further downhole tools wherein the high amplified portion of the hydraulic actuator stroke occurs when the valve block is within the narrow portion of the valve block housing. Further downhole tools wherein the short stoke piston is mechanically coupled to the sleeve through a rod which is slidingly engaged with the sleeve. Further downhole tools wherein the high amplified portion of the hydraulic actuator stroke releases a metal to metal seal. Further downhole tools comprising a bore passing through the valve block. Further downhole tools wherein the bore only has a fluid flow when the valve block is in a wide portion of the valve block housing. Further downhole tools wherein the high amplified portion of the hydraulic actuator stroke occurs near an end of the hydraulic actuator stroke.

Disclosed herein are numerous examples of downhole tools comprising a hydraulic actuator having a hydraulic actuator stroke with an high amplified portion and low amplified portion, a first piston head area moving with the hydraulic actuator stroke, and a second piston head area in fluid communication with the first piston head area such that forces generated at the first piston head area are transferred to the second piston head area wherein the force ratio produced during the high amplified portion compared to the forces produced during the low amplified portion is 2× or greater.

Further downhole tools comprising a short stroke piston which contains a third piston head area also placed in fluid communication with the first piston head area and slidingly engaged with a sleeve. Further downhole tools wherein the short stroke piston only moves during the high amplified portion of the hydraulic actuator stroke and bottoms out during the low amplified portion of the hydraulic actuator stroke. Further downhole tools comprising a narrow portion of a valve block housing which surrounds a valve block, and a wide portion of a valve block housing connected to the narrow portion of the valve block housing, wherein the valve block travels between both the narrow portion and the wide portion.

Disclosed herein are numerous examples of methods for operating a downhole tool comprising the steps of moving a hydraulic actuator through a hydraulic actuator stroke which causes a first piston head area to move through a first fluid, transferring fluid forces generated at the first piston head area to a second piston head area during a low amplified portion of the hydraulic actuator stroke, and transferring and amplifying the fluid forces generated at the first piston head area to the second piston head area only during a high amplified portion of the hydraulic actuator stroke.

Further methods comprising moving a short stroke piston only during the high amplified portion of the hydraulic actuator stroke. Further methods comprising moving a valve block through a narrow portion of a valve block housing and a wide portion of a valve block housing. Further methods comprising moving the valve block through the wide portion of the valve block housing only during the low amplified portion of the hydraulic actuator stroke. Further methods comprising moving a sleeve which is connected to the second piston head area, and uncovering one or more flow ports by moving the sleeve.

100 platform
105 sea level
110 production riser
115 blow out preventer (BOP)
120 tubing hanger
125 well system
130 well casing
135 power conductor
140 hydraulic control/injection lines
145 formation
150 open hole section (ie. no casing)
155 data acquisition and control unit
160 electrical umbilical
165 seabed
180 downhole tool
185 work string
200 tool body
205 actuator electronics
210 motor control electronics (eg. motor controller(s))
215 electrical conductors to other motors and their rotational feedback sensors
220 electrical conductors to motor and body position sensor 280
225 motor rotational feedback sensor (eg. hall sensors, resolver, encoder or similar)
230 motor
235 gearbox
240 output shaft
245 screw
250 coupling
255 sleeve
260 flow ports
265 bore
270 additional motor assembly
280 body position sensor
290 mandrel
300 seal
310 first bore
320 second bore
330 first fluid flow
340 second fluid flow
345 third fluid flow
350 fluid
370 first piston head area
375 piston
377 short stroke piston
380 second piston head area
382 third piston head area
390 first fluid compartment
400 second fluid compartment
410 third fluid compartment
420 fourth fluid compartment
425 fifth fluid compartment
430 sixth fluid compartment
470 hydraulic actuator
480 ball
490 gap
500 packer
525 seal
540 stop
550 valve block
560 piston head of valve block
570 seal
580 narrow portion
590 wide portion
600 bore
620 accumulator piston
625 accumulator compartment
650 push wedge
675 pull wedge
700 rod
720 rod
730 aperture
740 seal FIG. 1 illustrates a schematic view of a well system 125 that may employ the principles of the present disclosure within one or more downhole tools 180. A platform 100 may be positioned on the surface of the sea and held at sea level 105. Alternatively, the embodiments herein can also be practiced with land-based drilling and well production, where the sea level 105 would instead be ground level. A blow out preventer (BOP) 115 may be positioned on the sea bed 165 with a production riser 110 connected to the BOP 115. A tubing hanger 120 may be positioned at the sea bed 165 to support the well casing 130. An power conductor 135 may then run down the work string 185 and will connect to the internal components of the downhole tool 180 as will be described further below. In some embodiments, the power conductor 135 contains an electrical conductor to deliver electrical power to the downhole tools 180. In other embodiments, the power conductor 135 contains a hydraulic conduit to deliver hydraulic power to the downhole tool 180.

Generally speaking, a series of well casings 130 may be connected and run through the wellbore until the deepest part of the wellbore which lacks any casing which is also referred to as the open hole section 150 of the well, typically in a desirable area of a geological formation 145. The embodiments herein provide for downhole tools 180 which can be used in any section of a well including both the sections that include well casings 130 or sections which are open 150.

Figure 2:
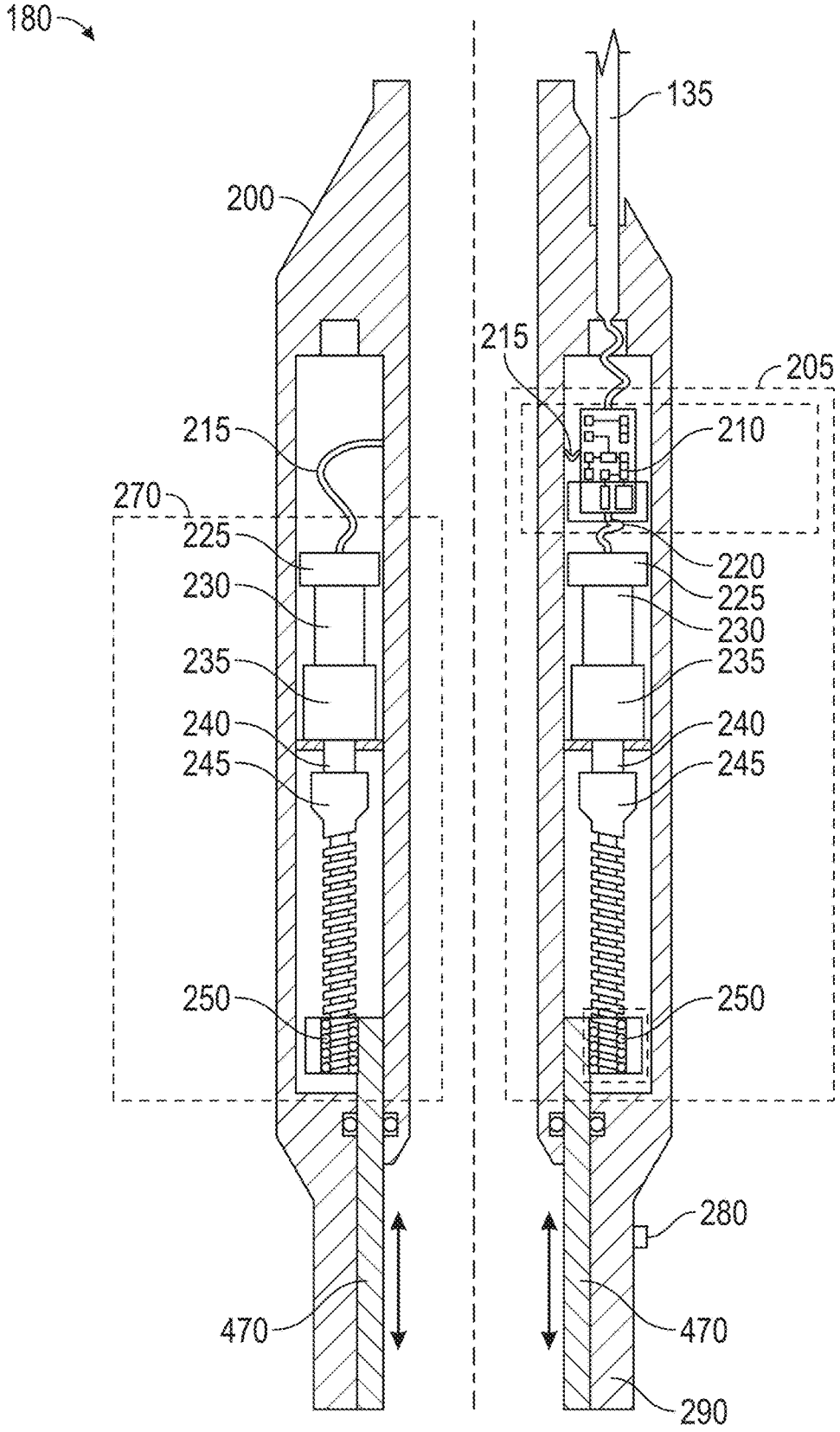
FIG. 2 illustrates a cross-sectional side view of a downhole tool having a threaded member or screw used with a coupler for the hydraulic actuator.

FIG. 2 illustrates a cross-sectional side view of one embodiment of a downhole tool 180 having one or more motors along with an embodiment of the motor control system. The power conductor 135 may be electrical or hydraulic or a combination and may traverse through the work string 185 until entering the tool body 200. When running an electrical power conductor 135, it would connect with the actuator electronics 205 which may contain a motor controller 210. An electrical conductor (or multiple conductors) 220 may exit the actuator electronics 205 to connect with a motor 230 and various sensors within the downhole tool 180 including but not limited to a motor rotational feedback sensor 225. The output shaft of the motor 230 may then be connected to a gearbox 235 which has an output shaft 240 that connects to some type of mechanical body, in this embodiment a screw 245 may be threaded into a coupling 250. In alternative embodiments, the mechanical body could be a valve or the output shaft 240 may itself be the mechanical body. In other embodiments, a power conductor 135 may not be used and the downhole tool may be powered using a downhole power source such as a battery, capacitor, a downhole energy harvester or similar.

Here, a hydraulic actuator 470 may be connected to the coupling 250 such that rotation of the screw 245 may cause a linear translation of the hydraulic actuator 470. The downhole tool 180 also preferably includes a bore 265 that runs down the central axis of the downhole tool 180. In some embodiments, a body position sensor 280 may be positioned near the mechanical body that is connected to the gearbox 235 to determine the position of the mechanical body. In this embodiment, the body position sensor 280 may be positioned to determine the linear position of the hydraulic actuator 470 (which may be mechanically coupled to a sleeve as it extends and retracts to cover the plurality of flow ports 260 as shown and described further below). This sensor 280 can provide feedback to the control system of the present location of the hydraulic actuator 470 or sleeve 255 (or other mechanical body), allowing it to confirm movement when the hydraulic actuator 470 or sleeve 255 is being moved and to stop the movement at the intended location.

Similarly, embodiments of the downhole tool 180 can contain one or more additional motor assemblies 270 including the following components: motor rotational feedback sensor 225, motor 230, gearbox 235, screw 245, and coupling 250. In some embodiments, each additional motor assembly 270 may be connected to its own hydraulic actuator 470 or sleeve 255 or in other embodiments each motor assembly may also connect to the same sleeve 255.

While the embodiments herein may show the use of an interval control valve or sliding sleeve, one of ordinary skill in the art can also apply this system to ball valves, safety valves, packers, bridge plugs, and others without substantial modifications and it would be within the scope of this disclosure. In some embodiments, the hydraulic actuator 470 may include the screw 245 and sometimes the coupling 250 but it should be understood that the disclosure herein can be practiced with any type of hydraulic actuator including but not limited to: mechanical/electromechanical hydraulic actuators, hydraulic hydraulic actuators, pneumatic hydraulic actuators, piezoelectric actuators, electrohydraulic actuators and others. Electromechanical hydraulic actuators can further be of various types-some consist of a motor, gearbox and ball screw, others use an electrically powered pump to drive a linear piston. Yet others may use electromagnetism whereby the polarity of an electromagnet may be manipulated to drive a magnetic member forward or backwards.

Figure 3:
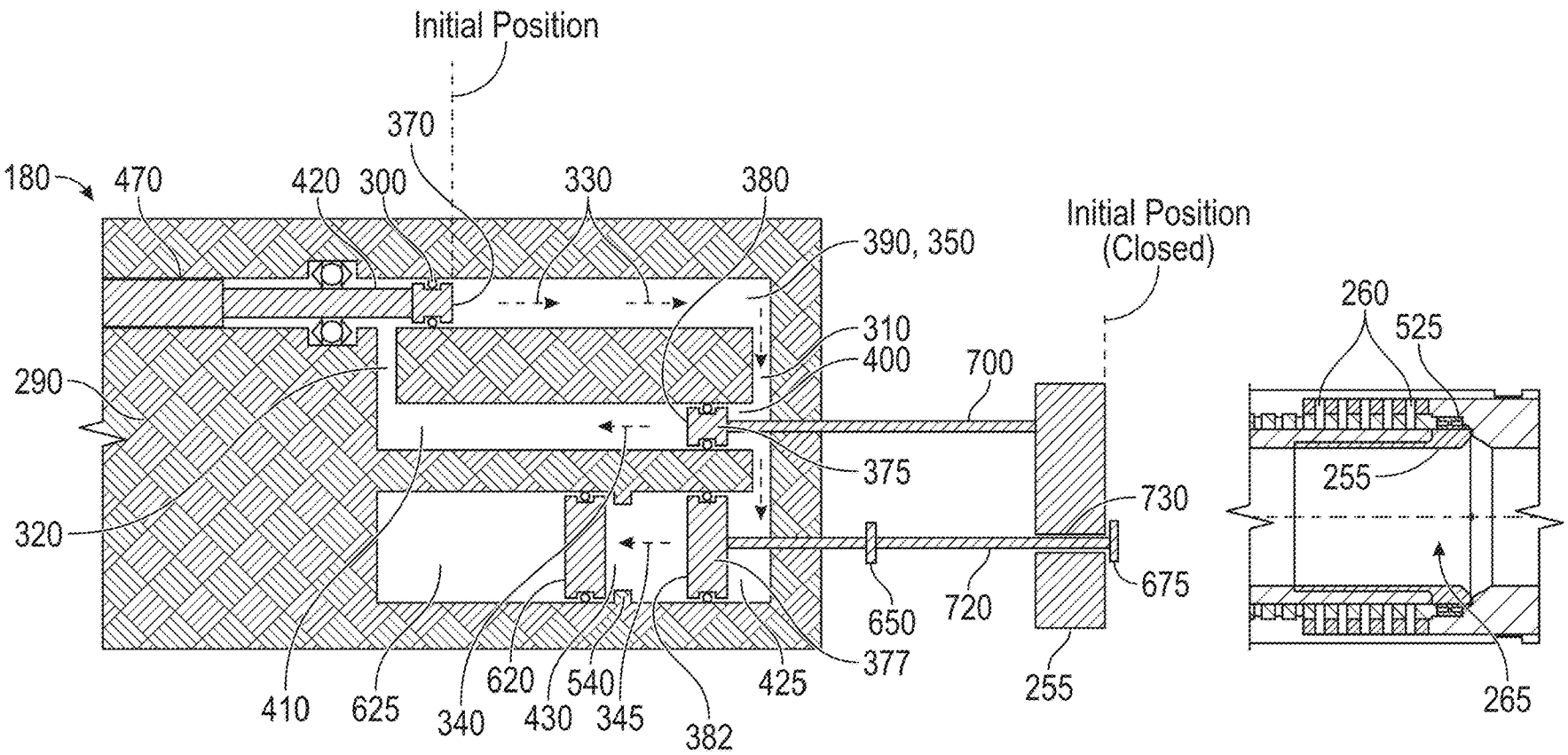
FIG. 3 illustrates a partial cross-sectional side view of another embodiment of a downhole tool comprising a hydraulic actuator with a high amplified stroke portion and low amplified stroke portion.

FIG. 3 illustrates a partial cross-sectional side view of another embodiment of a downhole tool 180 comprising a hydraulic actuator 470 with low or no amplification provided by a piston 375 along with high amplification provided by a short stroke piston 377. The piston 375 and the short stroke piston 377 may be mechanically coupled to the sleeve 255, such that linear translation of the piston 375 and the short stroke piston 377 may be transferred to the sleeve 255 (in other words so that the piston 375 and the short stroke piston 377 move together along with the sleeve 255). A first fluid compartment 390 may be placed in fluid communication with a second fluid compartment 400 through a first bore 310. The first fluid compartment 390, first bore 310, and second fluid compartment 400 may each contain a fluid 350. A first piston head area 370 extending from one end of the hydraulic actuator 470 may also be placed in fluid contact with the fluid 350. In some embodiments the first piston head area 370 may be positioned on the downhole side of the hydraulic actuator 470 but this is not required.

The third fluid compartment 410 may be in fluid communication with a fourth fluid compartment 420 through a second bore 320. The third fluid compartment 410, fourth fluid compartment 420, and second bore 320 may each contain a fluid. A seal 300 may be positioned to prevent fluid communication between the first fluid compartment 390 and the fourth fluid compartment 420. The hydraulic actuator 470 could be any type of hydraulic actuator and may be fluidly coupled to the second piston head area 380 and third piston head area 382 through a connected chain of two fluid compartments and first bore 310. In other embodiments, the hydraulic actuator 470 may be housed inside a separate component that is then connected to an existing downhole tool to practice this disclosure.

In this particular application, the first fluid compartment 390 may also be in fluid communication with a fifth fluid compartment 425, which may contain a third piston head area 382. A short stroke piston 377 may be connected to or contain the third piston head area 382 such that fluid 350 may flow through the first fluid flow 330 into both the second fluid compartment 400 as well as the fifth fluid compartment 425. Upon entering the fifth fluid compartment 425, the fluid 350 may be forced against the third piston head area 382, causing the short stroke piston 377 to move from a starting position to an intermediate position. The movement of the short stroke piston 377 may cause a third fluid flow 345 into the sixth fluid compartment 430 (which could be a compartment, the annulus of the wellbore, or a fluid reservoir). In some embodiments, the third fluid flow 345 may contact an optional accumulator piston 620 which travels within an optional accumulator compartment 625. The optional accumulator piston 620 may have the same or a different area than the third piston head area 382.

In operation, as the hydraulic actuator 470 travels in a first linear direction to the right the first piston head area 370 applies a force against the fluid 350 to cause a first fluid flow 330 into both the second fluid compartment 400 and the fifth fluid compartment 425. The first fluid flow 330 may then contact both the second piston head area 380 (to cause movement of the piston 375) and the third piston head area 382 (to cause movement of the short stroke piston 377), each of which may be mechanically coupled to the sleeve 255. At the same time, movement of the piston 375 may cause a second fluid flow 340 where fluid flows from the third fluid compartment 410 into the fourth fluid compartment 420 through the second bore 320.

In some embodiments, the piston 375 may be mechanically coupled to the sleeve 255 through a rod 700. Further, the short stroke piston 377 may be mechanically coupled to a rod 720 at one end of the rod 720, while the opposing end of the rod 720 may slidingly engage with the sleeve 255 by passing through an aperture 730 in the sleeve 255. The rod 720 may contain a pull wedge 675 at the opposing end of the rod 720 such that movement of the rod 720 (and pull wedge 675) pulls against the sleeve 255 such that the sleeve 255 moves with the short stroke piston 377 during the high amplified portion of the hydraulic actuator 470 stroke. A push wedge 650 may be positioned on the rod 720 so that movement of the short stroke piston 377 in the opposite direction (towards the initial position) could move the sleeve 255 back to its initial position.

Preferably the first piston head area 370 is smaller than the third piston head area 382 such that force applied at the third piston head area 382 would be larger than the force applied at the first piston head area 370. Speaking generally regarding Pascal's law, the force F applied by the hydraulic actuator 470 may generate a pressure of F/A1 where A1 is the area of the third piston head area 382. This pressure may then be transmitted to the third piston head area 382 and the force generated there will be (F/A1)×A2 where A2 is the area of third piston head area 382. However, as the force applied to the third piston head area 382 increases, so does the amount of linear travel that the hydraulic actuator 470 must now complete to achieve this increase in power. For example, if the third piston head area 382 is 5 times the size of the first piston head area 370, the forces applied at the third piston head area 382 would be 5 times greater than the forces applied at the first piston head area 370, but the hydraulic actuator 470 would now have to travel approximately 5 times the previous linear distance (not accounting for losses due to friction/heat). This principle is generally a linear relationship, such that a third piston head area 382 that is twice the size of the first piston head area 370 may produce a force at the third piston head area 382 that is approximately twice the amount of force applied at the first piston head area 370, but the hydraulic actuator 470 would now have to travel approximately twice the previous linear distance (not accounting for losses due to friction/heat). Consequently, the force output of the hydraulic actuator 470 may be amplified, high amplified, or multiplied when required but subsequently, be low amplified or generate a reduced force (or no longer amplify or multiply the output of the hydraulic actuator 470 so that the travel of the linear actuator 470 equates to a near equivalent travel on the sleeve 255).

Preferably, third piston head area 382 is larger than second piston head area 380 so that very large forces are generated during the initial stages where short stroke piston 377 hasn't bottom out yet on stop 540. The sleeve 255 may be moved to cover or expose one or more flow ports 260. In this way, the sleeve 255 may be used to perform a flow control operation by closing and opening any desired number of flow ports 260. In the closed state of the tool shown, the sleeve 255 is positioned so that all of the flow ports 260 are covered/closed which would prevent fluids passing through the bore 265 of the tool from exiting the interior of the tool. In the closed state, there may be a seal 525 placed between the sleeve 255 and the ports 260. The initial position of the sleeve 255 may keep the seal 525 fluid tight. Overcoming this force can require more force than moving the sleeve 255 otherwise, which is where the short stroke piston 377 can be useful.

During this initial stage of the device, which is typically the unloading of a seal (but as shown below it can also be the setting of a packer or opening of a ball valve), often times a seal 525 (especially a metal to metal seal), a large amount of force may be required to remove the sleeve 255 from the seal 525. During this initial stage, first fluid flow 330 may be fluidically communicated to both second piston head area 380 as well as third piston head area 382. As a non-limiting example, second piston head area 380 may provide the same area as the first piston head area 370 whereas third piston head area 382 may be substantially larger than the first piston head area 370. As an example, assuming that third piston head area 382 is 5× larger than the first piston head area 370. In this example, in this initial stage when 330 is fluidically communicating to both piston head areas 380 and 382, the force from the actuator may be multiplied 6× (5×+1×=6×). This provides sufficient force to unload from the seal 525. However, it also means that the hydraulic actuator 470 needs to move 6× the distance moved by sleeve 255.

Figure 4:
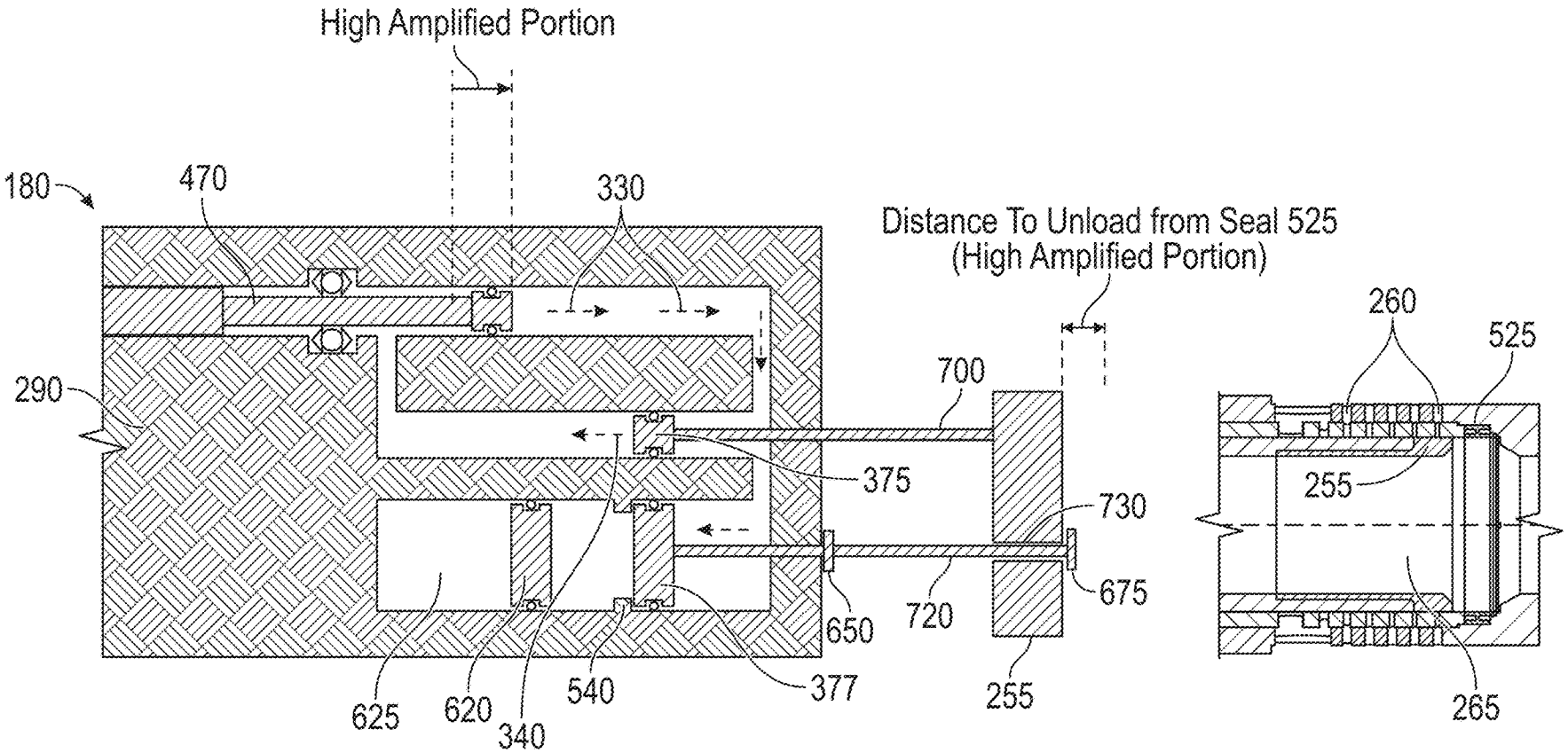
FIG. 4 illustrates a partial cross-sectional side view of the downhole tool shown in FIG. 3 where the hydraulic actuator moves through the high amplified portion and the sleeve eventually moves enough to unload the seal.

FIG. 4 illustrates a partial cross-sectional side view of the downhole tool shown in FIG. 3 where the hydraulic actuator 470 moves through the high amplified portion and the sleeve 255 eventually moves enough to unload the seal 525. The push wedge 650 may be positioned on the rod 720 such that when the short stroke piston 377 bottoms out against the stop 540, the push wedge 650 would also contact the mandrel 290. At this point the short stroke piston 377 may stop any further movement while the piston 375 continues its movement causing the sleeve 255 to travel with the movement of the piston 375, due to its mechanical engagement through the rod 700.

Figure 5:
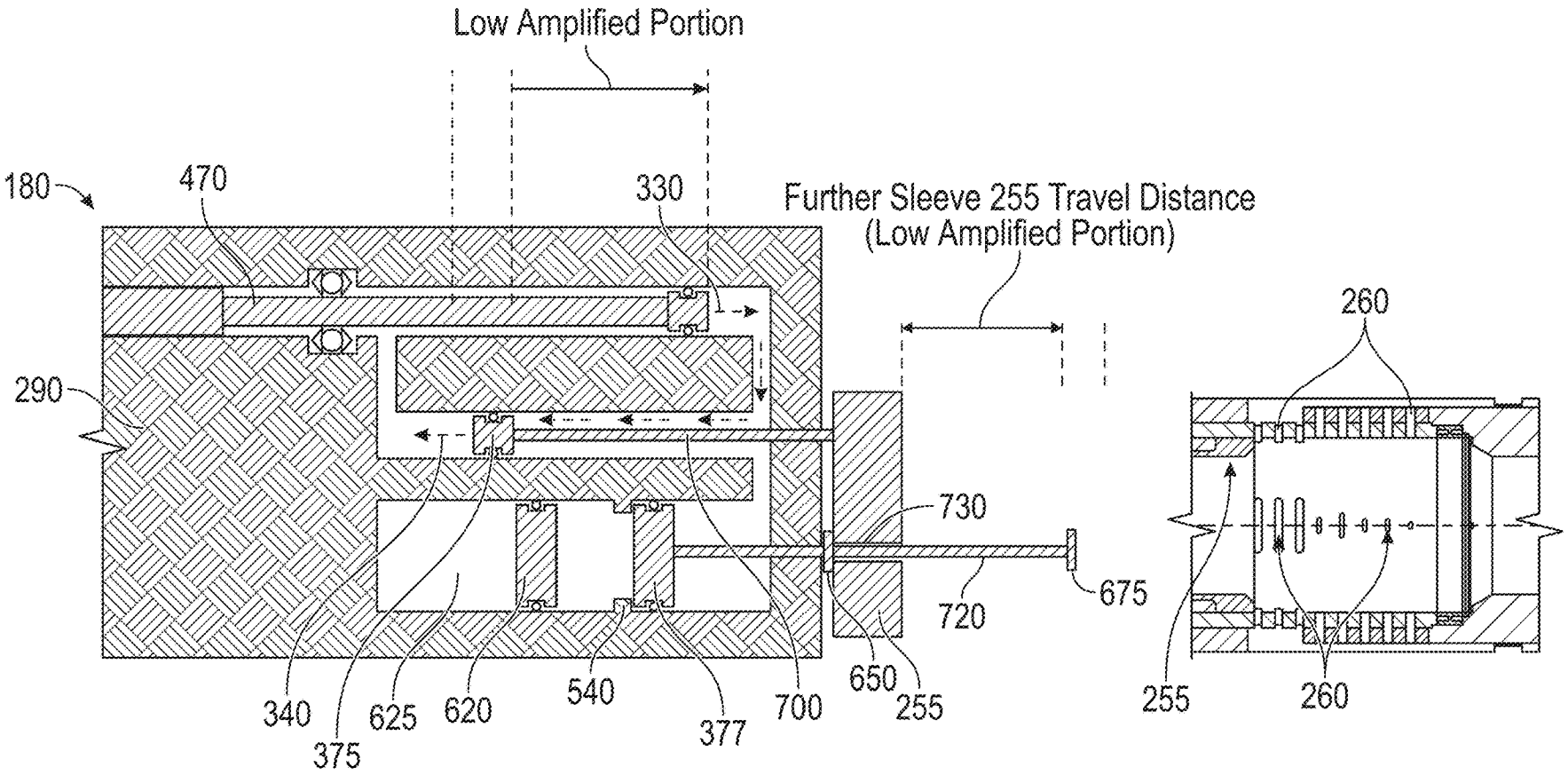
FIG. 5 illustrates a partial cross-sectional side view of the downhole tool shown in FIG. 3 where the short stroke piston has bottomed out and the hydraulic actuator moves through the low amplified stroke portion.

FIG. 5 illustrates a partial cross-sectional side view of the downhole tool shown in FIG. 3 where the short stroke piston 377 has bottomed out and no longer moves even though the piston 375 may continue to move, where this portion of travel for the hydraulic actuator 470 may be referred to as the low amplified stroke portion. After the initial stage is performed, and the sleeve 255 has been removed from the seal 525, a high force is no longer needed such that the short stroke piston 377 is now permitted to bottom out against the stop 540 so that first piston head area 370 may be in fluid communication only with second piston head area 380 which provides in one example, little to no force amplification so that 1 inch movement on the hydraulic actuator 470 may translate directly to 1 inch movement on piston head area 380 and hence the sleeve 255. In this manner, the hydraulic actuator 470 stroke length may be traded for higher/increased output force when it is needed only for the initial phase, but afterwards the of the hydraulic actuator 470 stroke length may be conserved. Under this scenario, there may be little to no force amplification because first piston head area 370 may be similarly sized to the second piston head area 380. Again assuming as a non-limiting example, the ratio of areas between first piston head area 370 and second piston head area 380 in this example may be approximately 1:1 (not amplified); 0.25×-0.9×; 0.9×-2×. or less than 0.25×.

Both the short stroke piston 377 and the piston 375 may move linearly and they may move parallel to one another and sometimes in the same direction as shown here but this is not required. The short stroke piston 377 has a shorter travel than the piston 375, as its movement may be impeded eventually by the stop 540 which may comprise a shoulder or neck in the housing surrounding the short stroke piston 377. Once the short stroke piston 377 reaches the stop 540, the third fluid flow 345 may cease and the second piston head area 380 on the piston 375 may be taking all of the hydraulic force generated at the first piston head area 370. The piston 375 can then continue in this fashion and move from an intermediary position (shown in dashed lines) to a final position as shown here. In this way, while the hydraulic actuator 470 has continued down a single path, the forces generated by the hydraulic actuator 470 have been high amplified temporarily by the short stroke piston 377 while low or not amplified through the entire remaining stroke by the piston 375. The hydraulic forces generated at the first piston head area 370 may be high amplified initially until the short stroke piston 377 hits the stop 540 where the short stroke piston 377 would no longer help to high amplify the force of the hydraulic actuator 470.

Once the short stroke piston 377 has bottomed out and no longer moves (including the rod 720), the sleeve 255 can continue its movement since the aperture 730 in the sleeve 255 slidingly accepts the rod 720. Thus, once the movement of rod 720 has ceased, the sleeve 255 is now driven only by the rod 700. Using the aperture 730 allows the rod 720 to remain stationary as the rod 700 and the sleeve 255 can move together.

This allows a generation of high forces while trading off stroke length when a high force is needed such as when unloading from seal 525 in the case of a interval control valve or the initial phase of opening a ball valve. After this initial phase, a lower force may be sufficient and hence, to optimize the length of the hydraulic actuator 470 and the downhole tool 180, it may not be desirable to trade-off length and continue generating high forces. As a result, enabling short stroke piston 377 to hit stop 540 and subsequently, allowing the hydraulic actuator 470 to only be fluidically coupled to second piston head area 380 which may be smaller in size compared to third piston head area 382. This can ensure that the travel of the hydraulic actuator 470 is optimized because every inch of travel of the hydraulic actuator 470 will now equate to a higher amount of travel by second piston head area 380 and hence sleeve 255.

As a non-limiting example, second piston head area 380 may be substantially the same as first piston head area 370 whereas the third piston head area 382 attached to the short stroke piston 377 may be 5× the area of first piston head area 370. As a result, in the initial phase shown above, the force from the actuator may be multiplied/high amplified 6× (5×+1×=6×). After this step, the high amplified force is no longer needed so short stroke piston 377 is permitted to bottom out and cease linear movement at the stop 540, so that first piston head area 370 now communicates only with 380 and provides in one example, no force amplification so that 1 inch movement on the hydraulic actuator 470 may translate to 1 inch movement on second piston head area 380, 1 inch movement of the piston 375 and hence the sleeve 255 due to the mechanical coupling between the two. One skilled in the art with the benefit of this disclosure will be able to vary these parameters as a design choice to suit various downhole applications and the dimensions provided as an example herein should be used to limit the examples in any way. Assuming as a non-limiting example, the ratio of areas between first piston head area 370 and third piston head area 382 may be 1:10. Using this example, during the high amplification phase the output force of the hydraulic actuator 470 will now be high amplified 10× when applied to the sleeve 255 (or other element or tool actuator for movement). This example can be carried through various embodiments, including ratios for first piston head area 370:third piston head area 382 including but not limited to: A) 1:2, B) 1:5, C) 1:10, and D) 1:100 and anything in between.

Although shown in this orientation, embodiments could also have the hydraulic actuator 470 travel to the left while the sleeve 255 moves to the right, or where both components move in the same direction (both to the right/downhole or both to the left/uphole). The hydraulic actuator 470 may move linearly and in a direction that is parallel to the linear movement direction of the sleeve 255. When the first piston head area 370 is smaller than the second piston head area 380 as well as the third piston head area 382, the hydraulic actuator 470 may travel a further distance than the sleeve 255 each time the hydraulic actuator 470 moves.

Generally speaking, movement of the hydraulic actuator 470 in the opposite direction (backwards or to the left) may cause the sleeve 255 to also move in the opposite direction (backwards or to the right). In some embodiments, the actuator electronics 205 may be programmed to move the sleeve to any position and not necessarily only the starting and end positions described above.

The seal 300 may be positioned along the length of the hydraulic actuator 470 such that the seal 300 is placed between a first portion of the hydraulic actuator 470 which contacts fluid with the first piston head area 370 and a second portion of the hydraulic actuator 470 which contacts fluid along the length or body of the hydraulic actuator 470. Stated another way, the seal 300 may be positioned to prohibit fluid flow along or across the hydraulic actuator 470.

The hydraulic actuator 470 may have to reciprocate back and forth (cycle) between a first and second position multiple times in order to move the sleeve 255 the desired linear distance. For example, the hydraulic actuator 470 may reciprocate back and forth a span of 4 inches, 30 times over the span of 2 minutes in order to move the sleeve 255 several feet. Several of the variables can be altered to achieve the desired linear distance for the hydraulic actuator 470 and the sleeve 255. The stroke distance of the hydraulic actuator 470 (ie. distance from first position to second position) may be substantially less than the stroke distance of the sleeve 255 (i.e. distance from the start position to the end position).

The hydraulic actuator 470 may be constrained by the interior surfaces of the first fluid compartment 390 and the fourth fluid compartment 420 so that only linear movement is permitted, and the movement may be constrained by these compartments so that the linear movement is substantially parallel to the central axis. The sleeve 255 may be constrained by the interior surfaces of the second fluid compartment 400 so that only linear movement is permitted, and the movement may be constrained by the second fluid compartment 400 so that the linear movement is substantially parallel to the central axis. As shown herein, the interior surfaces of the first fluid compartment 390 and the fourth fluid compartment 420 are preferably aligned and generally parallel to provide a linear guide for the hydraulic actuator 470 to travel alongside and parallel with but in other embodiments, the hydraulic actuator may not travel parallel to the sleeve 255 as this is not a necessary condition for pressure intensification to take place or to practice the embodiments herein.

The fluid shown and described herein may be the same fluid in all fluid compartments or may be different fluids. The fluids may be incompressible fluids. As used herein, the term incompressible fluid means any fluid whose volume changes very little when placed under high pressure including but not limited to water, oils, and all hydraulic fluids. Whilst incompressible fluids are desirable as they minimize the tool length since one need not account for the compressibility of the fluid, the concepts described herein can just as easily be practiced with a compressible fluid without departing from the scope of this invention.

Though figures may show the hydraulic actuator 470 moving to the right in order to cause the sleeve 255 to move to the left, one skilled in the art will be able to practice this in reverse (i.e.) where the hydraulic actuator 470 moves to the left in order to move the sleeve 255 to the right. The start and end positions of the sleeve 255 may also be reversed from what is shown and likewise, the hydraulic actuator 470 may be situated to the right of the sleeve instead of to the left as shown. It is also possible to design a downhole tool whereby 330 connects to third fluid compartment 410 in which case the hydraulic actuator 470 and sleeve 255 would move in the same direction.

Figure 6:
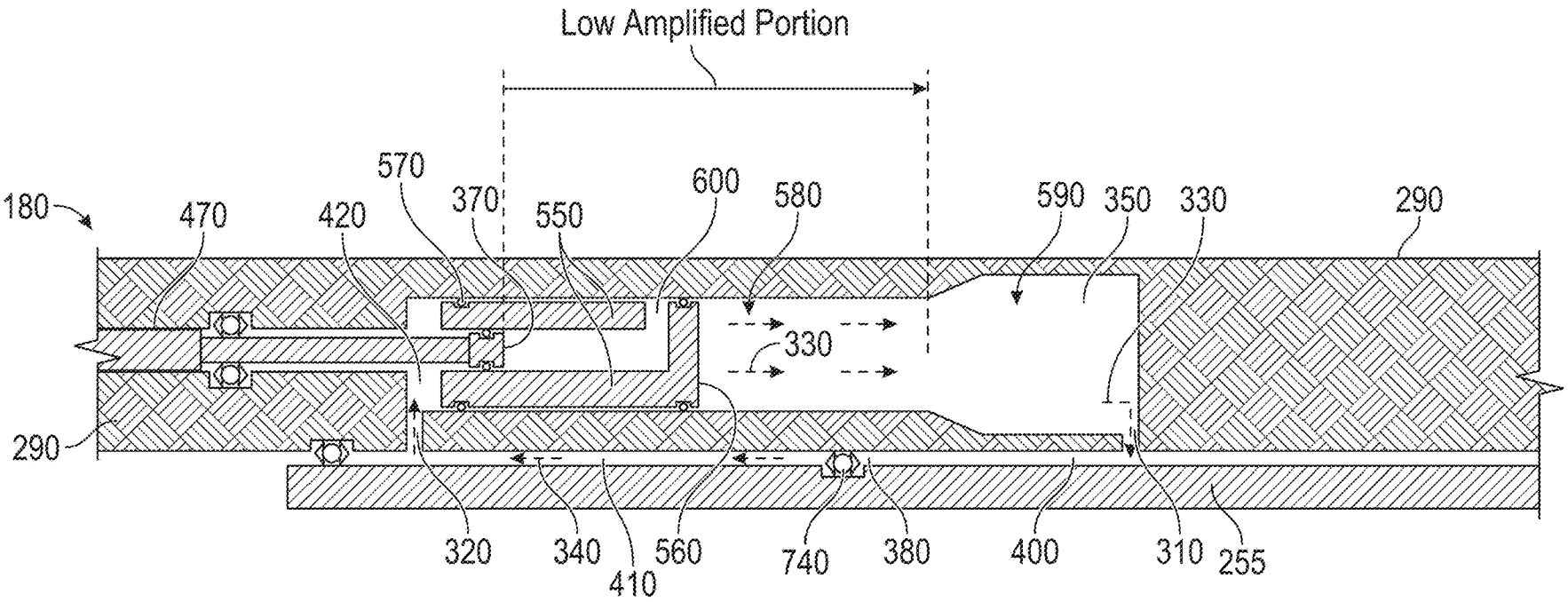
FIG. 6 illustrates a cross-sectional side view of another embodiment of a downhole tool comprising a hydraulic actuator with force amplification and showing a portion of the hydraulic actuator stroke where the force produced by the hydraulic actuator is high amplified.

FIG. 6 illustrates a cross-sectional side view of another embodiment of a downhole tool comprising a hydraulic actuator 470 with force amplification and showing a portion of the hydraulic actuator stroke where the force produced by the hydraulic actuator 470 is high amplified. A mandrel 290 may be placed along the center of the tool 180 and may support the tensile forces of the work string 185. A valve block 550 may travel within a channel of the mandrel 290 having a narrow portion 580 and a wide portion 590 of a valve block housing. When the valve block 550 is within the narrow portion 580 as shown (where the force produced by the hydraulic actuator 470 is high amplified), seals 570 prevent fluid from flowing through the bore 600 in the valve block 550 and instead force the valve block to move which creates a first fluid flow 330 generated at the piston head 560 of the valve block 550. The piston head 560 may push against the fluid 350 as the valve block 550 moves within the narrow portion 580 of a valve block housing. During this portion of the hydraulic actuator stroke there may be high amplification of the force by the valve block 550. As a non-limiting example, the ratio of areas between first piston head area 370 and piston head 560 may be 1:2. In this case, as long as valve block 550 is in the narrow portion 580, the force output of the hydraulic actuator 470 will be multiplied 2× but sleeve 255 will now travel (be displaced by) 2×. The first fluid flow 330 may be directed to a seal 740 which may be positioned between the sleeve 255 and the mandrel 290 and may include the second piston head area 380. Preferably, seal 740 is a dynamic seal and would travel with the sleeve 255.

Assuming as a non-limiting example, the ratio of areas between first piston head area 370 and piston head 560 may be 1:10. Using this example, during the high amplification phase the output force of the hydraulic actuator 470 will now be high amplified 10× when applied to the sleeve 255 (or other tool actuator element for movement). This example can be carried through various embodiments, including ratios for first piston head area 370 and piston head 560 including but not limited to: A) 1:2, B) 1:5, C) 1:10, and D) 1:100 and anything in between.

Figure 7:
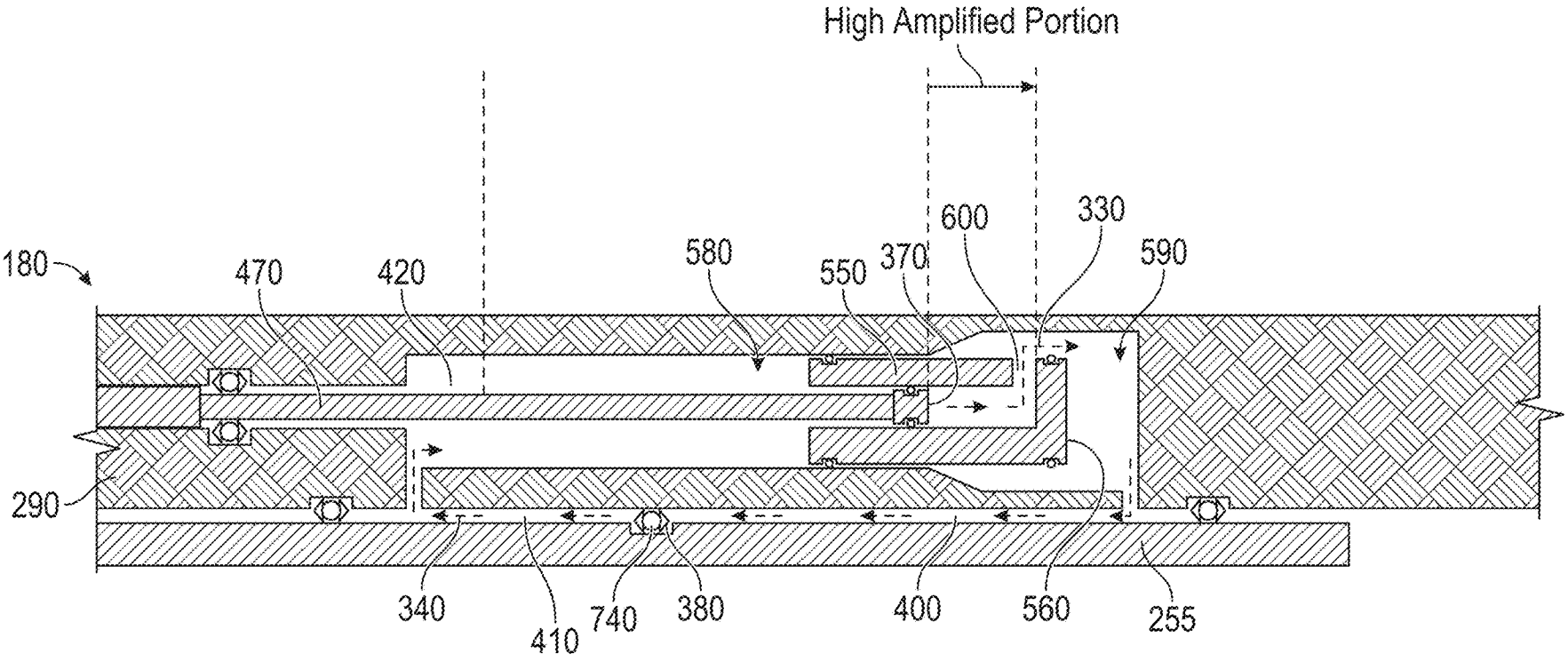
FIG. 7 illustrates a cross-sectional side view of the downhole tool shown in FIG. 6 showing a portion of the hydraulic actuator stroke where where the force produced by the hydraulic actuator is low amplified or not amplified.

FIG. 7 illustrates a cross-sectional side view of the downhole tool shown in FIG. 6 showing a portion of the hydraulic actuator stroke where where the force produced by the hydraulic actuator 470 is being not amplified or low amplified by the bore 600 which travels through the valve block 550. Once the valve block 550 has moved from the narrow portion 580 to the wide portion 590, the first piston head area 370 may cause a first fluid flow 330 through a bore 600 which may travel through a central portion of the valve block 550 and then pass between the valve block 550 and the wide portion 590 of the valve block housing in the mandrel 290 and into the first fluid compartment 390. Under this scenario, first piston head area 370 may be directly displacing the fluid acting on the second piston head area 380 and there may be little to no force amplification. Again assuming as a non-limiting example, the ratio of areas between first piston head area 370 and second piston head area 380 in this example may be approximately 1:1 (not amplified); 0.25×-0.9×; 0.9×-2×. or less than 0.25×.

Figure 8A:
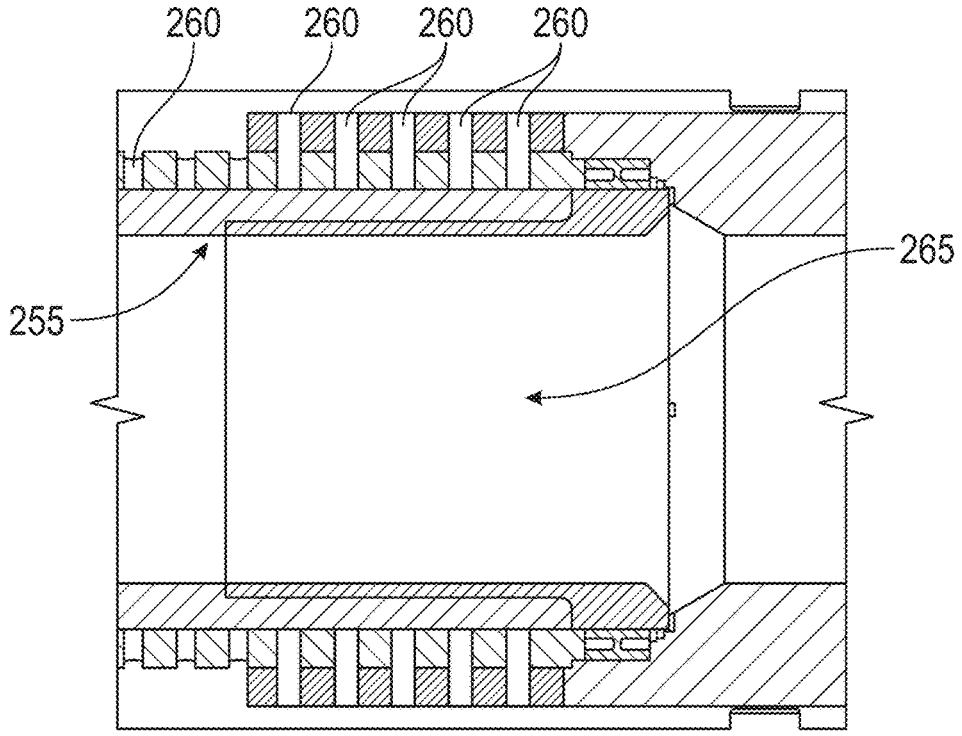
FIGS. 8A through 8D illustrate a cross-sectional side view of an embodiment of the downhole tool where the sleeve may be moved to cover or expose one or more flow ports.
Figure 8B:
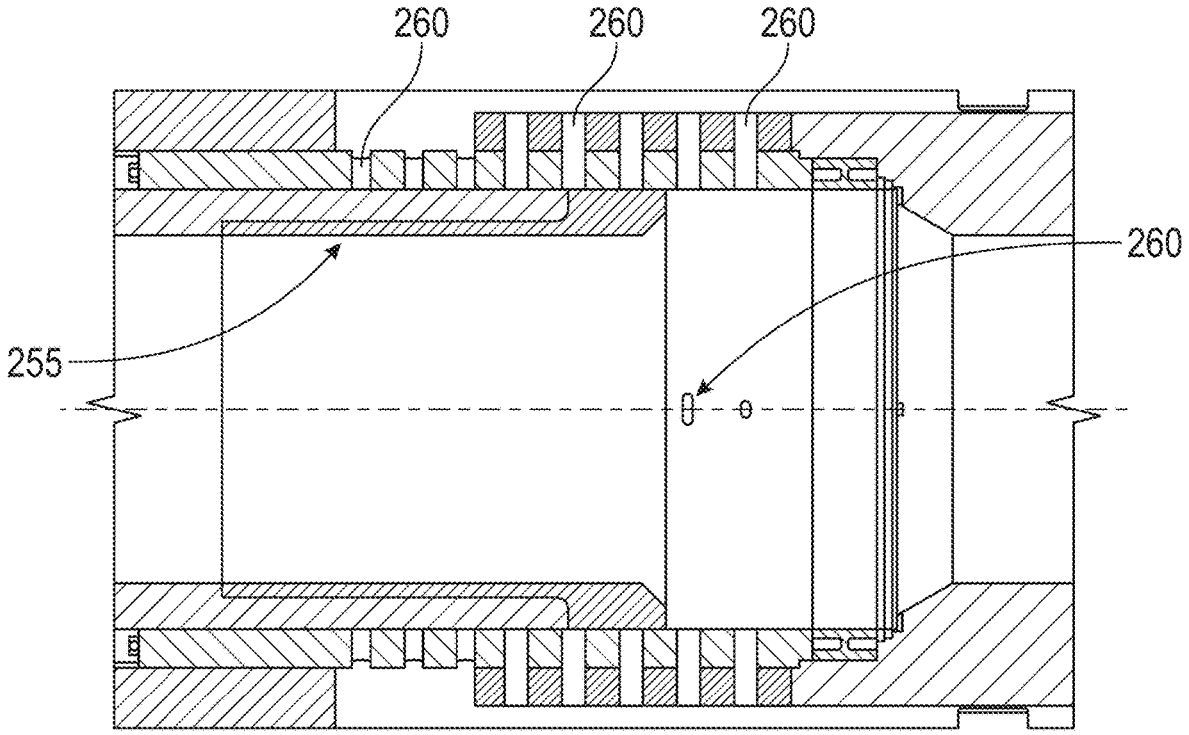
Figure 8C:
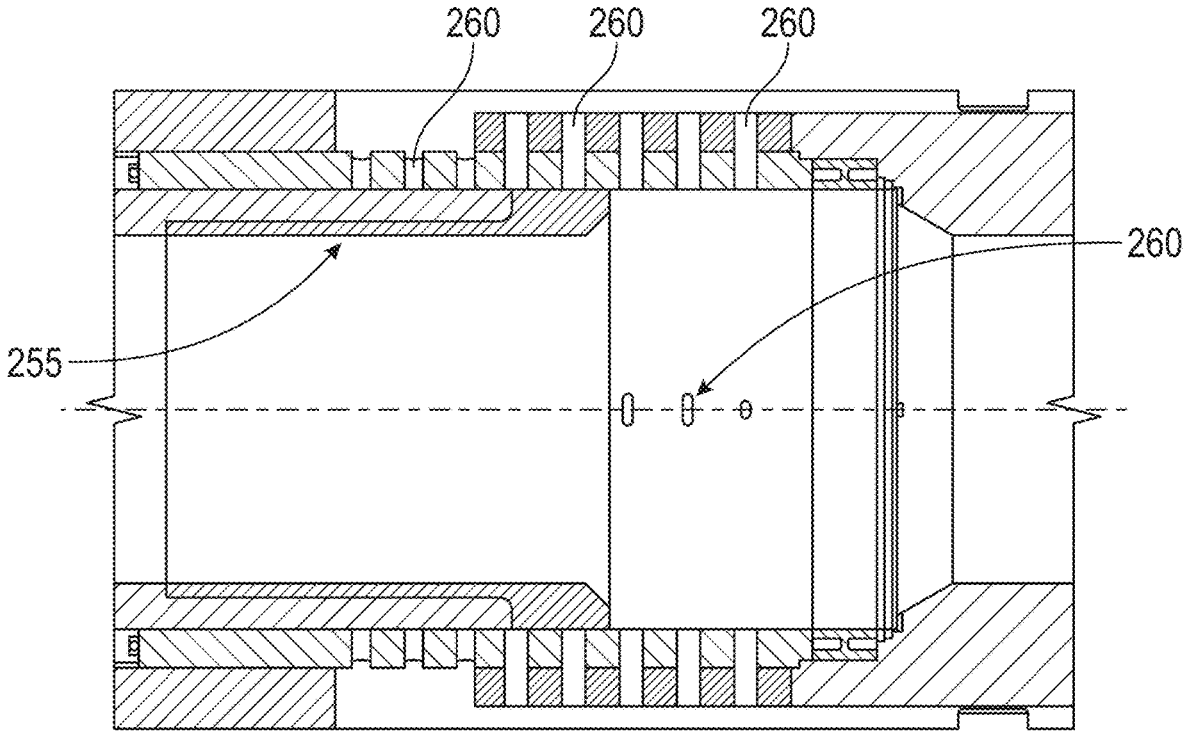
Figure 8D:
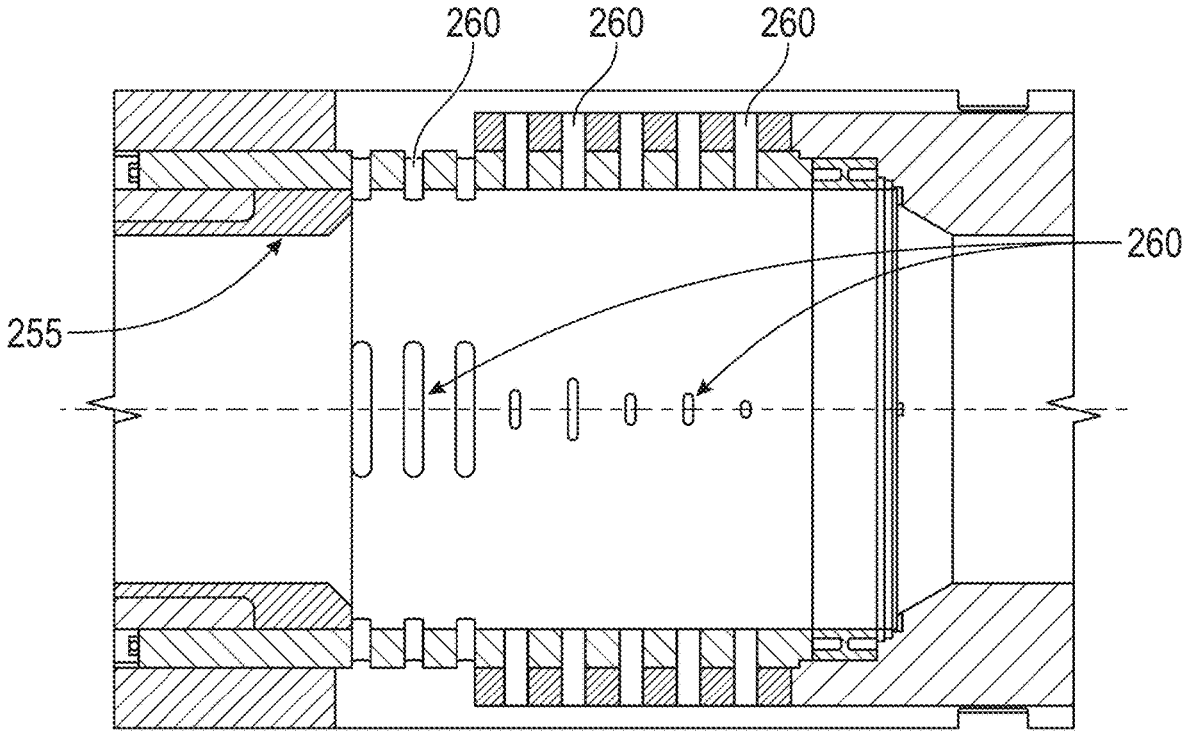

FIGS. 8A through 8D illustrate a cross-sectional side view of an embodiment of the downhole tool where the sleeve 255 may be moved to cover or expose one or more flow ports 260. In this way, the sleeve 255 may be used to perform a flow control operation by closing and opening any desired number of flow ports 260. In the closed state of the tool shown in FIG. 8A, the sleeve 255 is positioned so that all of the flow ports 260 are covered/closed which would prevent fluids passing through the bore 265 of the tool from exiting the interior of the tool. In FIG. 8B, the sleeve 255 has been moved such that two of the flow ports 260 have been uncovered/opened. In FIG. 8C, the sleeve 255 has been further moved such that three of the flow ports 260 have been uncovered/opened. In FIG. 8D, the sleeve 255 has been further moved such that all of the flow ports 260 have been uncovered/opened. This technique allows a precise amount of fluid flow to be controlled by the tool, changeable at any time, even when very large forces may be necessary to move the sleeve 255 but there is not enough space for a large motor or gear system.

Figure 9B:
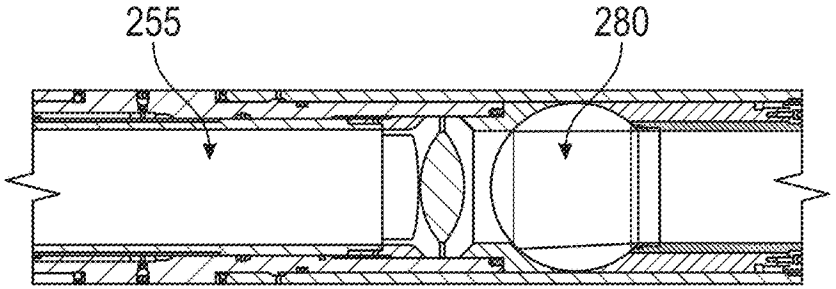
FIGS. 9A through 9B illustrate a cross-sectional side view of an embodiment of the downhole tool where the sleeve may be moved in order to move a ball used for a ball valve.
Figure 9A:
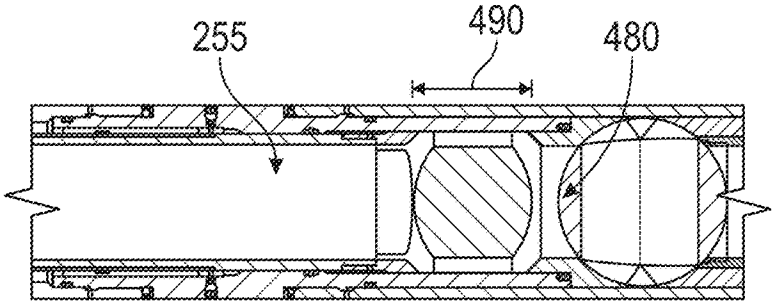

FIGS. 9A through 9B illustrate a cross-sectional side view of an embodiment of the downhole tool where the sleeve 255 may be moved in order to move a ball 480 used for a ball valve. In these types of valves a ball 480 may be positioned atop a ball seat where the ball 480 can be moved in order to open or close the valve. In FIG. 9A, there is a gap 490 shown between the sleeve 255 and the ball 480. In FIG. 9B, the sleeve 255 has moved and in the process the gap 490 has been closed and the ball 480 has been moved to open/close the valve.

Figure 10B:
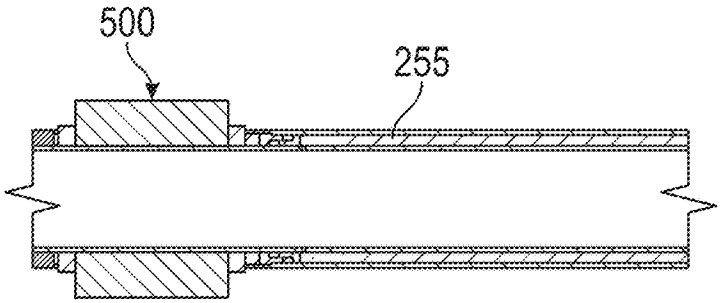
FIGS. 10A through 10B illustrate a cross-sectional side view of an embodiment of the downhole tool where the sleeve may be moved to expand or contract a packer.
Figure 10A:
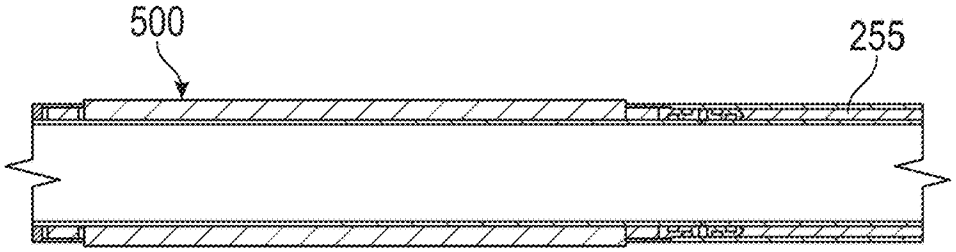

FIGS. 10A through 10B illustrate a cross-sectional side view of an embodiment of the downhole tool where the sleeve 255 may be moved to expand or contract a packer 500. In FIG. 10A, the packer 500 is shown having its full length, perhaps at a point when the packer 500 is first being sent down hole and the sealing of the wellbore is not yet required. In FIG. 10B, the sleeve 255 has moved in order to compress the packer 500 along its axis while expanding the packer 500 outwardly to contact the sidewalls of the wellbore and produce a fluid seal within the wellbore if and when desired. This process could then be reversed in order to remove the fluid seal and ultimately the packer 500 from the wellbore.

The hydraulic actuator 470 with first piston head area 370 can be considered to be a hydraulic actuator which creates a pressurized fluid flow. Many types of hydraulic actuators can be used including hydraulic pressure delivered from the surface along a hydraulic line or including a hydraulic pump such as provided by the Leduc Company. In some embodiments, the hydraulic actuator 470 may include the screw 245 and sometimes the coupling 250 but it should be understood that the disclosure herein can be practiced with any type of hydraulic actuator including but not limited to: mechanical/electromechanical hydraulic actuators, hydraulic hydraulic actuators, pneumatic hydraulic actuators, piezoelectric actuators, electrohydraulic actuators and others. Electromechanical hydraulic actuators can further be of various types-some consist of a motor, gearbox and ball screw, others use an electrically powered pump to drive a linear piston. Yet others may use electromagnetism whereby the polarity of an electromagnet may be manipulated to drive a magnetic member forward or backwards.

The term 'high amplified' is used herein to represent an amplification of the force output by the hydraulic actuator 470 by a factor that is greater than 2× and will generally be in the range from 2× to 100×. The term 'very high amplified' is a subset of the term 'high amplified' and is used herein to represent an amplification of the force output that is 4× or greater. The term 'low amplified' is used herein to represent an amplification that is less than 2× and will generally be in the range from 0.01× to 2×. The term 'not amplified' is a subset of the term 'low amplified' and is used herein to represent amplification of 0.5×-2×. The term 'very low amplified' is a subset of the term 'minimally amplified' and is used herein to represent amplification of less than 0.9×. The term 'amplified' has been used herein to represent any level of amplification above zero.

The term 'force ratio' is used herein to represent the ratio of the force generated in the portion of the actuation stroke where the force is high amplified to the force generated in the portion of the actuation stroke that is low amplified. The term 'high force ratio' is used herein to represent a force ratio that is greater than 2× and will generally be in the range from 2× to 100×. The term 'very high force ratio' is a subset of the term 'high force ratio' and is used herein to represent a force ratio that is 4× or greater. The term 'low force ratio' is used herein to represent a force amplification that is less than 2× and will generally be in the range from 1× to 2×.

The seals shown and described herein, including but not limited to seal 300, seal 570, and the seal 740 could comprise a single seal or several seals placed in series (i.e. a seal stack). The seals could be comprised of a flexible material such as a rubber or thermoplastic or could also provide a metal-to-metal seal. Non-limiting examples of seal 525 include a metal to metal seal, an elastomeric seal, or a seal made of composite material. Furthermore, the seal 525 may be a multi-component seal such as a vee packing.

A person having ordinary skill in the art will recognize that, although not required, in the embodiment(s) where the hydraulic actuator is a motor and gearbox-based actuator, a pressure compensation device may be added so that the motor and gearbox is always pressure balanced with the wellbore. Such a compensation system could be achieved with a floating piston, a bellow, a diaphragm, or any other type of accumulator. It would be advantageous to have this pressure compensation system equalize pressure with the bore 265 so that the seals or seal stacks used on the sleeve are always pressure balanced. This ensures that the closed fluid volume between the actuator and sleeve has no reason to ever leak away as it is always pressure balanced except during actuation when the pressure intensification is done.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole tool comprising:

a hydraulic actuator having a hydraulic actuator stroke with a high amplified portion and low amplified portion;

a first piston head area moving with the hydraulic actuator stroke to create fluid forces; and a second piston head area in fluid communication with the first piston head area such that during the high amplified portion of the hydraulic actuator stroke the fluid forces at the first piston head area are transferred to the second piston head area and high amplified while during the low amplified portion of the hydraulic actuator stroke the fluid forces at the first piston head area are transferred to the second piston head area and are low amplified.

2. The downhole tool of claim 1 further comprising:

a short stroke piston having a piston head area in fluid communication with the first piston head area where the short stroke piston is mechanically coupled to a sleeve.

3. The downhole tool of claim 2 wherein:

the short stroke piston is mechanically coupled to the sleeve through a rod which is slidingly engaged with the sleeve.

4. The downhole tool of claim 1 further comprising:

a valve block placed in fluid communication with the first piston head area.

5. The downhole tool of claim 4 further comprising:

a narrow portion of a valve block housing which surrounds the valve block; and a wide portion of a valve block housing connected to the narrow portion of the valve block housing;

wherein the valve block travels between both the narrow portion and the wide portion.

6. The downhole tool of claim 5 wherein:

the low amplified portion of the hydraulic actuator stroke occurs when the valve block is within the wide portion of the valve block housing.

7. The downhole tool of claim 5 wherein:

the high amplified portion of the hydraulic actuator stroke occurs when the valve block is within the narrow portion of the valve block housing.

8. The downhole tool of claim 4 further comprising:

a bore passing through the valve block.

9. The downhole tool of claim 8 wherein:

the bore only has a fluid flow when the valve block is in a wide portion of a valve block housing.

10. The downhole tool of claim 1 wherein:

the high amplified portion of the hydraulic actuator stroke releases a metal to metal seal.

11. The downhole tool of claim 1 wherein:

the high amplified portion of the hydraulic actuator stroke occurs near an end of the hydraulic actuator stroke.

12. A downhole tool comprising:

a hydraulic actuator having a hydraulic actuator stroke with an high amplified portion and low amplified portion;

a first piston head area moving with the hydraulic actuator stroke; and a second piston head area in fluid communication with the first piston head area such that forces generated at the first piston head area are transferred to the second piston head area;

wherein a force ratio between the forces generated during the high amplified portion compared to the forces generated during the low amplified portion is 2× or greater.

13. The downhole tool of claim 12 further comprising:

a short stroke piston which contains a third piston head area also placed in fluid communication with the first piston head area and slidingly engaged with a sleeve.

14. The downhole tool of claim 13 wherein:

the short stroke piston only moves during the high amplified portion of the hydraulic actuator stroke and bottoms out during the low amplified portion of the hydraulic actuator stroke.

15. The downhole tool of claim 12 further comprising:

a narrow portion of a valve block housing which surrounds a valve block; and a wide portion of a valve block housing connected to the narrow portion of the valve block housing;

wherein the valve block travels between both the narrow portion and the wide portion.

16. A method for operating a downhole tool comprising the steps of:

moving a hydraulic actuator through a hydraulic actuator stroke which causes a first piston head area to move through a first fluid;

transferring fluid forces generated at the first piston head area to a second piston head area during a low amplified portion of the hydraulic actuator stroke; and transferring and amplifying the fluid forces generated at the first piston head area to the second piston head area only during a high amplified portion of the hydraulic actuator stroke.

17. The method of claim 16 further comprising:

moving a short stroke piston only during the high amplified portion of the hydraulic actuator stroke.

18. The method of claim 16 further comprising:

moving a valve block through a narrow portion of a valve block housing and a wide portion of a valve block housing.

19. The method of claim 18 further comprising:

moving the valve block through the wide portion of the valve block housing only during the low amplified portion of the hydraulic actuator stroke.

20. The method of claim 19 further comprising:

moving a sleeve which is connected to the second piston head area; and uncovering one or more flow ports by moving the sleeve.

* * * * *